United States Patent [19]

Kawai et al.

[11] 4,055,780

[45] Oct. 25, 1977

[54] THERMIONIC EMISSION CATHODE HAVING A TIP OF A SINGLE CRYSTAL OF LANTHANUM HEXABORIDE

[75] Inventors: Shichio Kawai; Takaho Tanaka; Eisuke Bannai; Kenji Uchida, all of Sakura; Ryuichi Shimizu, Minou, all of Japan

[73] Assignee: National Institute for Researches in Inorganic Materials, Ibaraki, Japan

[21] Appl. No.: 675,963

[22] Filed: Apr. 12, 1976

[30] Foreign Application Priority Data

| | | |
|---|---|---|
| Apr. 10, 1975 | Japan | 50-43717 |
| Apr. 24, 1975 | Japan | 50-50135 |
| Sept. 4, 1975 | Japan | 50-107739 |

[51] Int. Cl.[2] ..... H01J 1/14; H01J 19/06; H01K 1/04

[52] U.S. Cl. ..... 313/346 R; 252/509; 252/521; 313/336

[58] Field of Search ..... 313/336, 346; 252/509, 252/518, 521

[56] References Cited

U.S. PATENT DOCUMENTS

| | | | |
|---|---|---|---|
| 3,312,856 | 4/1967 | Lafferty et al. | 313/346 R |
| 3,462,635 | 8/1969 | Broers | 313/346 R |
| 3,631,291 | 12/1971 | Favreau | 313/346 R |
| 3,823,337 | 7/1974 | Van Stratum et al. | 313/346 R |
| 3,833,494 | 9/1974 | Van Stratum et al. | 313/346 R |
| 3,928,783 | 12/1975 | Hosoki et al. | 313/346 R |
| 3,932,314 | 1/1976 | Kawabe et al. | 313/346 R |
| 3,944,866 | 3/1976 | Sayer | 313/346 R |

OTHER PUBLICATIONS

"$LaB_6$ Single-Crystal Tips as an Electron Source of High Brightness" by R. Shimizu & Kataoka - Applied Physics Letters, vol. 27, No. 3, pp. 113-114, Aug. 1975.

"Materials and Techniques for Electron Tubes" by Kohl., General Telephone & Electronics Technical Series" TK 6565, V3, K65, 1960, C4, pp. 548-550.

*Primary Examiner*—Saxfield Chatmon, Jr.

*Attorney, Agent, or Firm*—Oblon, Fisher, Spivak, McClelland & Maier

[57] ABSTRACT

A single crystal of lanthanum hexaboride is used as a tip of a thermionic emission cathode.

8 Claims, 5 Drawing Figures

THERMIONIC EMISSION CATHODE HAVING A TIP OF A SINGLE CRYSTAL OF LANTHANUM HEXABORIDE

BACKGROUND OF THE INVENTION

1. Field of the Invention

The present invention relates to a thermionic emission cathode which is useful for electron beam apparatus.

2. Description of the Prior Art

Recently, in the field of electron beam apparatus such as scanning electron microscopes, electron beam processing apparatus and fine recording apparatus, it has been desired to have an electron beam source with a submicron diameter which also is very bright.

In general, the characteristics of thermionic emission are dependent upon the value of the work function of the particular material employed. The work function of tungsten which has been used in practice is 4.65 eV (sintered material), whereas the work function of lanthanum hexaboride is 2.66 eV (sintered material) which, of course, is smaller. This means that use of lanthanum hexaboride results in much emission current. Using a figure of merit equal to (work function)/Te (temperature required to provide $10^{-5}$ Torr of vapor pressure of the cathode material) as a basis for evaluation of a cathode, tungsten has a value of $1.6 \times 10^{-3}$, lanthanum hexaboride has a value of $1.27 \times 10^{-3}$ and Ba-O-Wa value of $0.95 - 1.05 \times 10^{-3}$. A mono-atomic layer of Ba-O-W is superior to the others. However, it is difficult to maintain the surface of a cathode made of that material in the optimum condition. A lanthanum hexaboride cathode has been tested recently by cutting and processing a sintered lanthanum hexaboride in a desired size. An electron beam emitted from such a sintered lanthanum hexaboride cathode has been compared with that of a tungsten cathode and the advantageous characteristics thereof have been recognized. For example, the brightness using tungsten is $6.2 \times 10^4$ A/cm$^2$.str (2,500° C) whereas the brightness using lanthanum hexaboride is $5 \times 10^5$A/cm$^2$.str (12 KV at 1,700° C) which is a high brightness. Moreover under the same brightness, the life of lantanum hexaboride is more than 100 times that of tungsten. Also the beam diameter provided by lanthanum hexaboride is several A which is similar to that of a field emission electron gun. A field emission type tungsten cathode gives a high brightness electron beam having a brightness of $\sim 10^9$ A/cm$^2$.str (100KW) in a very high vacuum such as $\sim 10^{-9}$ Torr. However, when the high vacuum conditions are lowered, the emission current becomes quite unstable because of the effects of residual gas. Accordingly, the very high vacuum of $\sim 10^{-9}$ Torr must be maintained in the apparatus using an electron beam.

This is a severe disadvantage for practical use.

For use in forming suitable structures for a sintered lanthanum hexaboride cathode, there have been proposed a method of heating it by direct passage of current using graphite as a cathode holder, and a method of heating one end of a sintered rod by radiant heat and an electron shock produced by a tungsten coil while holding the other end by a cooled copper block. Such structures are complicated compared with the conventional tungsten hair-pin type electron guns. Moreover, it is difficult to fix the sintered lanthanum hexaboride cathode on the holder of a scanning electron microscope or an electron microscope. Furthermore, it is preferred to reduce the curvature at the top of the cathode. However, the minimum curvature achievable has been about 10 μm because of the necessity to shape it by mechanical grinding. Accordingly, it has been difficult to provide the desirable thermionic emission efficiency in the lanthanum hexaboride.

SUMMARY OF THE INVENTION

Accordingly, it is an object of this invention to provide a thermionic emission cathode for a high brightness submicron electron beam having small beam diameter, which can be used in an electron beam apparatus. This and other objects of this invention have been attained by using a single crystal of lanthanum hexaboride as a thermionic emission cathode. The thermionic emission cathode of this invention comprises a tip made of a single crystal of lanthanum hexaboride and a holder for fixing said tip. The tip is heated by direct passage of current through the holder, so that thermionic electrons are emitted from the top of the tip.

Figure 1:
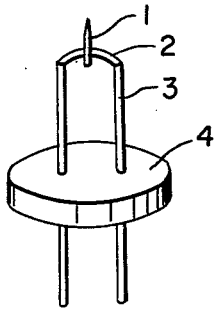
FIG. 1 is a schematic view of one embodiment of the thermionic emission cathode of invention.

DETAILED DESCRIPTION OF THE PREFERRED EMBODIMENTS:

The tip used for the thermionic emission cathode of this invention is prepared by cutting a single crystal of lanthanum hexaboride and polishing it by an electrolytic polishing operation.

It is preferred to prepare the tip as follows.

Powdered lanthanum hexaboride is compressed to form a rod and the rod is sintered. The sintered rod is inserted in a high frequency coil ring and is moved relative to the coil whereby the sintered lanthanum hexaboride rod is locally heated to higher than the sintering temperature thereof. Thus, it is melted and solidified whereby a single crystal of lanthanum hexaboride is formed.

The single crystal lanthanum hexaboride is then cut or processed and is inserted in a ring having a film of electrolyte. Current is passed between the single crystal and the ring to form a sharp end on the single crystal at that part in contact with the electrolyte. The powdered lanthanum hexaboride is preferred to have an average particle diameter of less than 5 μm, especially less than 2 μm. The powdered lanthanum hexaboride is compressed under a pressure higher than 100 Kg/cm$^2$, especially higher than 200 Kg/cm$^2$ in a mold. It is preferred to compress it under a pressure higher than 300 Kg/cm$^2$, and then to compress it further under a hydraulic pressure of higher than 1,000 Kg/cm$^2$. The compressed rod is sintered by heating it at 1,800° – 2,200° C for 15 – 60 min. by high frequency induction heating in an argon gas atmosphere. The resulting sintered rod is then induction-heated in a high frequency coil at 2,000° to 3,000° C, preferably 2,400° to 2,700° C, under a pressure of 1 to 50 atm., preferably 5 to 30 atm., in an argon gas atmosphere.

The sintered rod is moved relative to the high frequency coil at a rate of 5 to 40 mm/hour, preferably 15 to 25 mm/hour. In order to improve the purity of the single crystal, it is preferred to repeat the steps of melting and crystallization two or more times. The impurities are collected at one end of the single crystal because lanthanum hexaboride has a high melting point and a high density. For example, the resulting single crystal may have a diameter of 8 to 10 mm and a length of 200 to 400 mm and has directional characteristics. The single crystal should be cut or processed to form a tip having a diameter of 0.05 to 5 mm and a length of 0.1 to 30 mm.

The electrolytic polishing operation can be conducted before or after the mounting of the tip on the holder.

It is preferred to prepare a tip having a sharp end having a curvature of less than 5 μm and a diameter of 0.01 to 5 mm, preferably 0.05 to 1 mm, and a length of 0.1 to 30 mm, preferably 0.5 to 10 mm, especially a diameter of about 0.2 mm and a length of about 4 mm. The single crystal of lanthanum hexaboride can be prepared by the floating zone method or the aluminum flux method. The floating zone method has been illustrated above. In the aluminum flux method, lanthanum hexaboride is heated in aluminum metal (or Zn or La) at about 1,500°, and is cooled from 1,500° to 1,000° C in 3 to 5 hours, whereby lanthanum hexaboride ($LaB_6$) melted in aluminum is solidified as a single crystal. For example, a single crystal having a size of 5 × 5 × 5 mm can be prepared. Such a single crystal has directional characteristics. Accordingly, it is possible to have the desired directional characteristics by selecting the direction of the cut.

The neddle-like tip made of lanthanum hexaboride is fixed on a holder and the sharp end of the tip is formed by an electrolytic polishing operation. The tip can be fixed on the holder by melting or mechanical holding. A heating element is used at least near the parts used to hold the various types of holders and the nature of the needle-like tip can be selected depending upon the desired structure of the thermionic emission cathode.

Referring to the Drawings, certain embodiments of the invention will be illustrated.

Figure 2:
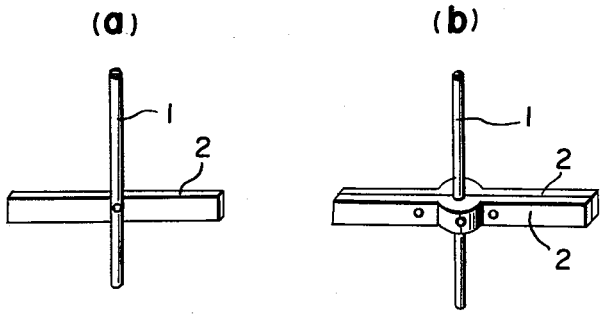
FIGS. 2 (*a*) and (*b*) are schematic views of a tip and a holder.

FIG. 1 shows one embodiment of the thermionic emission cathode wherein the tip of single crystal of lanthanum hexaboride (1) can be fixed on the holder (2) having a ribbon or filament shape, which is attached to the frame (3) and (4), by spot welding such as by electron beam welding or laser beam welding and by heat spot welding (FIG. 2*a*), or by holding the needle-like tip of the single crystal of lanthanum hexaboride between a pair of ribbon or filament holders, pressing it and welding the holders or the contacted part by spot welding (FIG. 2*b*) and the like.

The holder (2) used in this invention should have high heat resistance, should be inactive to lanthanum hexaboride at high temperatures and should be conductive to enable electric heating by passage of current. The holder is preferably weldable to the needle-like tip of the single crystal of lanthanum hexaboride. Suitable materials for the holder include tantalum, rhenium, molybdenum silicide, carbide and carbon. The shape of the holder can be seleced according to the desired purpose. A typical holder has a diameter of 0.1 to 0.5 mm and a length of 3 mm for a filament holder and a thickness of 0.05 mm and a width of 1 mm for a ribbon holder.

Figure 3:
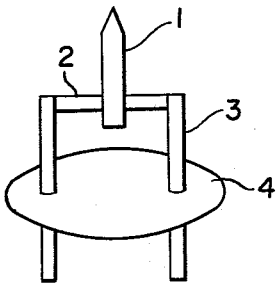
FIG. 3 is a schematic view of another embodiment of the thermionic emission cathode of this invention.

A typical holder made of carbon has a diameter of 0.1 to 5 mm and a length of 1 to 30 mm for a filament holder and a thickness of 0.1 to 3 mm and a width of 0.5 to 5 mm for a ribbon holder. The tip of single crystal is held as shown in FIG. 3.

Figure 5:
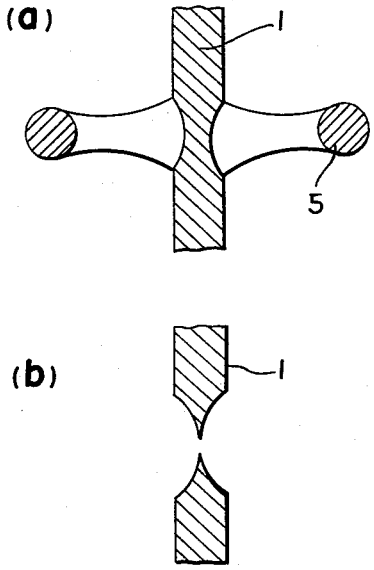
FIGS. 5 (*a*) and (*b*) are sectional views of a sharp end of a tip and of the formation thereof.
Figure 4:
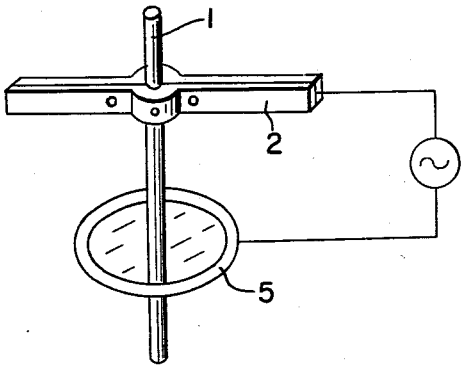
FIG. 4 is a schematic view of an electrolytic polishing procedure.

Referring to FIGS. 4 and 5, the electrolytic polishing operation for forming the sharp end of the tip of single crystal will be illustrated. FIG. 4 shows the electrolytic polishing of a tip after fixing of the tip on the holder, and FIGS. 5 (*a*) and, (*b*) show conditions of formation of the sharp end of the tip.

The tip (1) on the holder (2) is inserted in a ring (5) made of platinum and a film of electrolyte is formed on the ring. A DC or AC power source is connected between the tip and the ring whereby the tip is cut in an electrolytic polishing operation to from a sharp end on the tip passing through the conditions shown in FIGS. 5 (*a*) and (*b*).

The platinum ring usually has a ring diameter of 2 to 10 mm and a wire diameter of 0.1 to 2 mm. A typical electrolyte comprises 30 - 70 vol. % of water, 20 - 40 vol. % of phosphoric acid and 10 -30 vol. % of glycerin. In the electrolytic polishing operation, a stoichometric reaction of phosphoric acid and glycerin is conducted to form $C_3H_5(OH)_2H_2PO_3$, producing a desirable viscosity, and a Jacqet layer for the electrolytic polishing, is formed on the lanthanum hexaboride. The convex part is quickly dissolved while the concave part is slowly dissolved to form a lustrous polished surface.

The current and voltage applied in the electrolytic polishing are usually in the range of 0.5 to 10 V and 1 to 50 mA; preferably 2 to 6V and 15 to 30 mA, at the initial stage.

The electrolytic polishing operation is usually conducted by using a new electrolyte as efficiency is decreased by the contamination. The diameter of the sharp end of the tip is less than 5 μm whereby the brightness produced by thermionic emission is several times that of a hair-pin tungsten cathode or a sintered lanthanum hexaboride cathode under the same vacuum and heating power condition.

It is possible to use such a thermionic emission cathode under a vacuum only about $10^{-5}$ Torr.

For the thermionic emission cathode of this invention, the holder is fixed on the frame (3) by welding as shown in FIG. 1 and the frame (3) is supported by an insulator (4).

The cathode is disposed at the thermionic emission part of an electron beam apparatus.

In use, current is passed from the frame (3) to the holder (2) whereby the temperature of the holder is increased by Joule heating. Thermionic emission is attained from the end of tip by conducting heat to the tip of the single crystal of lanthanum hexaboride.

It is also possible to directly heat it by passing current through the holder as well as to indirectly heat it by passing current through a tungsten coil disposed around the tip of the single crystal thereby providing radiant heat and emitted electrons.

The thermionic emission cathode of this invention can be used for the cathode of a scanning electron microscope. Emission currents of 100 μA (25 KV) can be provided under normal vacuum conditions of $10^{-4}$ to $10^{-5}$ ton, heating currents of 2A, and brightness of about $10^5$A/cm$^2$.str.

The fluctuation in the emission current is less than about several %, and no difficulties have been observed in tests.

In order to measure the contrast and the resolving power of the scanned image, a magnetic tape has been used and the results compared with those of a tungsten cathode. The results show a brightness several times higher than for a tungsten cathode, an improved resolving power and a superior contrast.

It has also been confirmed that the shape of the sharp end of the single crystal of lanthanum hexaboride is not changed, by the observation under a microscope. The thermionic emission cathode of this invention can be used as a cathode in electron beam processing apparatus and in microscopes.

Suitable conditions are given above.

The following is one example of a method for preparing the sharp end of the tip.

EXAMPLE:

A powdered lanthanum hexaboride having a purity of 99.9% was crushed by a stainless-steel ball mill to obtain an average particle of less than 4 μm.

The powder was washed with hydrochloric acid and was compressed in a mold under 200 Kg/cm$^2$ to obtain a molded product (10 × 10 × 200 mm). The molded product was further compressed under 300 Kg/cm$^2$ and then compressed by hydraulic pressure of 1,000 Kg/cm$^2$ in order to increase the density.

The molded product was sintered at 2,000° C for 30 minutes in a graphite susceptor by a high frequency heating operation.

The sintered product was heated in a high temperature-high pressure kiln used for preparing a single crystal under 10 atm. of argon gas at a rate of growth of the crystal of 20 mm/hr., whereby a single crystal having a diameter of 8 mm and a length of 30 mm was obtained. The single crystal was cut by an arc discharge method to obtain a cut single crystal having a [100] direction, a diameter of 0.2 mm and a length of 5 mm. The cut single crystal was treated by an electrolytic polishing operation using an electrolyte of 50 vol. % of water, 30 vol. % of phosphoric acid and 20 vol. % of glycerin, and using a ring made of platinum having a diameter of 0.3 mm and a ring diameter of 4 mm, under the electrolytic conditions of 4V and 20 mA. The electrolyte was changed during the electrolytic polishing operation.

A tip of a thermionic emission cathode having a sharp end (0.1 μm of curvature) was obtained.

What is claimed as new and desired to be secured by letters patent of the U.S. is:

1. A thermionic emission cathode which comprises a tip which includes only a single crystal of lanthanum hexaboride.

2. The thermionic emission cathode of claim 1 wherein the tip of a single crystal of lanthanum hexaboride is fixed on a holder which can be heated by passage of current.

3. The thermionic emission cathode of claim 1 wherein the tip is fixed on a holder made of tantalum, rhenium, molybdenum or silicide.

4. The thermionic emission cathode of claim 1 wherein the tip is fixed on a holder made of carbon or carbide.

5. The thermionic emission cathode of claim 1 wherein the tip is cut from a single crystal of lanthanum hexaboride and its sharp end is formed by electrolytic polishing.

6. The thermionic emission cathode of claim 5 wherein the electrolytic polishing is conducted by inserting the tip in a ring, forming a film of electrolyte thereon and passing current through the electrolyte.

7. The thermionic emission cathode of claim 5 wherein the single crystal of lanthanum hexaboride is formed by induction heating a sintered rod prepared by compressing powdered lanthanum hexaboride.

8. The thermionic emission cathode of claim 1, wherein the tip is fixed on a holder which is held on a frame mounted on an insulator.

* * * * *